US012235058B2

(12) United States Patent
Bilgeri et al.

(10) Patent No.: US 12,235,058 B2
(45) Date of Patent: Feb. 25, 2025

(54) BOLT FOR A FIREARM

(71) Applicant: GLOCK TECHNOLOGY GMBH, Ferlach (AT)

(72) Inventors: Elmar Bilgeri, Klagenfurt (AT); Michael Kriz, Vienna (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 18/431,685

(22) PCT Filed: Jul. 20, 2022

(86) PCT No.: PCT/EP2022/070325

§ 371 (c)(1),
(2) Date: Feb. 2, 2024

(87) PCT Pub. No.: WO2023/011921

PCT Pub. Date: Feb. 9, 2023

(65) Prior Publication Data

US 2024/0337455 A1 Oct. 10, 2024

(30) Foreign Application Priority Data

Aug. 3, 2021 (EP) ..... 21189286

(51) Int. Cl.
*F41A 15/14* (2006.01)

(52) U.S. Cl.
CPC ..... *F41A 15/14* (2013.01)

(58) Field of Classification Search
CPC ..... F41A 15/00; F41A 15/12; F41A 15/14; F41A 15/16
See application file for complete search history.

(56) References Cited

U.S. PATENT DOCUMENTS 136,850 A * 3/1873 Milbank ..... F41A 15/14 42/16
431,670 A * 7/1890 Mauser ..... F41A 15/14 42/25

(Continued)

FOREIGN PATENT DOCUMENTS

CH 214423 A 4/1941
CN 113739626 A * 12/2021

(Continued)

*Primary Examiner* — Gabriel J. Klein
(74) *Attorney, Agent, or Firm* — Raven Patents, LLC; Anton E. Skaugset

(57) ABSTRACT

A bolt for a firearm having an extractor for cartridge cases, comprising a cylindrical body having a locking portion with a breech face, an undercut, groove-shaped, rearwardly-running recess for an extractor with an extractor claw and a leaf spring, as well as an inwardly-projecting bearing protrusion and a second lever arm with a rearwardly-projecting spring bearing portion. The bearing protrusion is designed to be hook-shaped so as to abut against the extractor axis in the installed state with a bearing opening open rearwardly, and, on the body, the groove-shaped recess for receiving the leaf spring is laterally open at least partially on one side tangentially to the circumferential direction, via an insertion portion, and is designed to merge laterally and/or rearwardly into the undercut, and the body has a cavity for receiving the bearing protrusion relative to an imaginary plane of the recess in the region of the extractor axis.

17 Claims, 5 Drawing Sheets

(56) References Cited

U.S. PATENT DOCUMENTS

| | | | | | |
|---|---|---|---|---|---|
| 808,463 | A | * | 12/1905 | Luger | F41A 15/14 42/16 |
| 1,352,515 | A | * | 9/1920 | Hulse | F41A 15/14 42/25 |
| 1,507,900 | A | * | 9/1924 | Frommer | F41A 15/14 42/25 |
| 1,544,566 | A | * | 7/1925 | Eickhoff | F41A 15/14 42/25 |
| 2,591,733 | A | * | 4/1952 | Simpson | F41A 15/14 42/25 |
| 2,712,192 | A | * | 7/1955 | Dixon | F41A 15/14 42/25 |
| 3,608,223 | A | | 9/1971 | Dieckmann | |
| 6,182,389 | B1 | | 2/2001 | Lewis | |
| 7,331,135 | B2 | | 2/2008 | Shimi | |
| 10,215,518 | B1 | | 2/2019 | Kramer | |

FOREIGN PATENT DOCUMENTS

| | | | | | |
|---|---|---|---|---|---|
| DE | 437957 | C | * | 12/1923 | |
| DE | 695924 | C | | 9/1940 | |
| DE | 739617 | C | * | 9/1943 | |
| DE | 853118 | C | | 10/1952 | |
| DE | 1578387 | A1 | | 5/1971 | |
| DE | 2530705 | A | * | 1/1977 | F41A 15/14 |
| FR | 578615 | A | * | 10/1924 | |
| GB | 191208157 | A | * | 7/1913 | |
| GB | 128287 | A | * | 6/1919 | |
| GB | 160773 | A | | 8/1921 | |
| GB | 183776 | A | | 8/1922 | |
| GB | 222784 | A | * | 10/1924 | |
| GB | 972692 | A | | 10/1964 | |

* cited by examiner

BOLT FOR A FIREARM

TECHNICAL FIELD

The present disclosure relates to firearms, and more particularly the present disclosure relates to a bolt for a firearm having an extractor for cartridges or cartridge cases. The bolt includes a cylindrical body having a groove-shaped recess for receiving the extractor, as well as a spring element.

BACKGROUND

Firearms with a rotating bolt have long been known. Examples are the breechblock systems of rifles of the types M4/M16/AR15, AK47/74, Steyr AUG, as well as their derivatives. In the case of these weapons, the breechblock comprises a bolt carrier arranged movably in the receiver or the upper receiver, also called a breechblock carrier, as well as a bolt that can be rotated and displaced about the barrel axis in the bolt carrier.

Before a shot can be fired, a cartridge is inserted from the magazine into the chamber. As the cartridge is supplied, the bolt is usually rotated during the locking process by the interaction of a cam pin, which is arranged on the bolt, with a cam, which is arranged in the bolt carrier. The bottom of the cartridge case abuts against the breech face of the bolt. A locking portion of the bolt, or the locking lugs arranged thereon, interact with corresponding locking lugs of the barrel or a receiver in order to lock the weapon to the outside for firing a shot.

Generally, an extractor is arranged on the bolt in order to extract the fired cartridge case from the chamber after the shot has been fired in the course of the unlocking process. However, this extractor should release the cartridge case again as easily as possible at a predefined position of the bolt carrier or the bolt, which is usually supported by an ejector. Naturally, ejection disorders that result in feed jamming, when the next cartridge is fed, are undesirable.

The movements of the bolt relative to the bolt carrier, or the interaction with an ejector, which is responsible for ejecting the cartridge case from the firearm, are sufficiently known to a person skilled in the art as highly dynamic processes.

Numerous extractor devices have been presented in the past with the aim of ensuring the most reliable extraction of the cartridge case even with a high rate of fire and, moreover, a long service life under operating conditions. In a figurative sense, this requirement naturally also applies to cartridges that have not been fired, as can happen in the case of, for example, primer failure or with snap caps during training.

A few ideas for bolts with extractors that are pretensioned by one (DE 695 924 C) or more (U.S. Pat. No. 3,608,223 A) coil springs should be mentioned here as examples. Further measures concerned, for example, a widening of the locking lug on the extractor in U.S. Pat. No. 10,215,518 B1, the arrangement of a plurality of spiral springs to pretension the extractor as in U.S. Pat. No. 6,182,389 B1 or DE 853118 C, or the asymmetrical design of the bolt of U.S. Pat. No. 7,331,135 B2 for forming a system for the extractor. A disadvantage of using coil springs can be that they tend to soften more quickly under the influence of heat due to their filigree construction, i.e. permanent loss of resilient properties. This can result in an increased tendency to prevent extraction or premature material fatigue and thus breakage.

To improve the durability and the reliability in the operation of extractors of automatic firearms, numerous other measures are known in the prior art in which a leaf spring was used as an alternative to pretension the extractor. Using the example of DE 1578387 A1, a U-shaped leaf spring was used, which has an inwardly protruding extractor claw on one side. CH 214423 A shows a T-shaped extractor device, the long leg being designed as a kind of leaf spring and at the same time acting as a spring element and extractor. In GB 972692 A a curved leaf spring is used to pretension a pin-shaped extractor on its rear side, while in GB 160773 A a straight leaf spring acts on the rear side of the extractor.

As early as 1922, GB 183776 A alternatively presented an extractor device having a leaf spring, which is arranged in a bolt with a cylindrical body in a groove-shaped recess. The bolt has—as is generally customary—on the barrel side a locking portion with a breech face, on which a plurality of radially outwardly projecting locking lugs and a rearwardly running groove-shaped recess with an undercut for receiving the extractor and the leaf spring are formed. In the installed state, viewed towards the barrel side, the extractor has a first lever arm with an inwardly protruding, hook-shaped extractor claw, and in a central portion an inwardly protruding bearing protrusion, i.e. in the direction of the barrel axis. The extractor is mounted on the body with this bearing protrusion so as to be pivotable about an edge. This edge acts as a kind of bearing point or extractor axis, around which the leaf spring pretensions the extractor inwardly by means of a second lever arm which protrudes rearwardly as a spring bearing portion, counter to the barrel direction. The bearing protrusion is open to the front, which is necessary to tension the extractor forward by pressing in the leaf spring.

However, the above-mentioned extractors with helical or leaf springs usually have the common disadvantage that, during the closing process and when gripping the cartridge case at its edge, a high pressure load briefly occurs on the extractor along the barrel axis before it is deflected transversely to it and snaps into place at the edge of the cartridge. In the previously known extractor devices, these forces in the longitudinal direction on the extractor are often diverted into the bolt from the extractor axis, which secures the extractor in the bolt. In the case of leaf springs that hold the extractor in the bolt at the same time, such as GB 183776 A, CH 214423 A, or GB 160773 A, these forces are often transmitted directly to the leaf spring. In comparison to coil springs, leaf springs are relatively sensitive to excessive compressive pressure load. In particular, forces that are transverse to the intended loading direction of the leaf spring, i.e., for example, in the direction of the barrel axis, can result in compression or even destruction of the leaf spring, as a result of which functional reliability is no longer ensured.

An inherent disadvantage of the solutions of the prior art is also that assembly or disassembly is often only possible using tools. This is particularly important when, in the event of soiling, icing, or failure of a defective extractor or spring element, repair and/or maintenance is often impossible under operating conditions.

Another problem with the solutions of the prior art is often that the case ejection of the gripped cartridge cases takes place under uncontrolled conditions, which can primarily be expressed in different ejection directions from the firearm. This can be uncomfortable for the shooter and those around him. In the worst case, however, this can result in the cartridge case becoming wedged in the weapon housing and in jamming.

The content of the aforementioned publications, in particular in the English language, are hereby incorporated by reference.

There is therefore a need for an extractor device or a bolt which avoids or at least reduces these disadvantages.

The aim of the present disclosure is accordingly to provide a bolt having an extraction device that can withstand high mechanical and/or thermal loads. In addition, the disclosed extraction device can be constructed simply, i.e. preferably with as few components as possible, and/or so that it allows for a relatively simple (dis) assembly. In some aspects, the bolt of the present disclosure improves the functionality and precision of case ejection.

SUMMARY

The present disclosure provides bolts for firearms that have an extractor for cartridge cases.

In some examples, the disclosure may provide a bolt for a firearm including an extractor for cartridge cases that can include a cylindrical body, where on a side of the cylindrical body nearest a barrel of the firearm is formed a locking portion having a breech face, at least two radially outwardly projecting locking lugs, and a groove-shaped recess extending rearwardly from the breech face. The groove-shaped recess defines an undercut that is configured to receive the extractor and a leaf spring; the groove-shaped recess is laterally open at least partially on one side tangentially to a circumferential direction, via an insertion portion, and merges laterally and/or rearwardly into the undercut. The extractor, which when installed with the cylindrical body has a first lever arm on a barrel side of the cylindrical body, the first lever arm including an inwardly protruding, hook-shaped extractor claw; and, in a central portion of the extractor, has an inwardly-projecting bearing protrusion and a second lever arm including a rearwardly-projecting spring bearing portion that is configured to be mounted on the cylindrical body so as to be pivotable about an extractor axis, and to interact with the leaf spring to pretension the extractor. The bearing protrusion is designed to be hook-shaped so as to abut against the extractor axis when installed, and defines a rearwardly-opening bearing opening, and includes a contacting surface on a barrel side of the bearing protrusion, and the cylindrical body further defines a cavity for receiving the bearing protrusion relative to an imaginary plane of the groove-shaped recess in a region of the extractor axis.

DETAILED DESCRIPTION

Figure 1A:
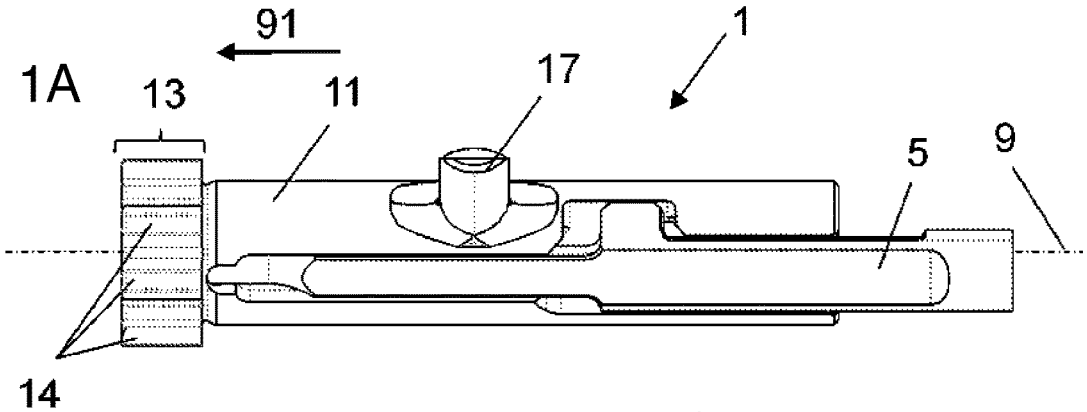
FIGS. 1A and 1B are schematic side views of a bolt according to the present disclosure.

Compared to previously known casing extractors, the interaction of the features of the bolts of the present disclosure create a very robust and relatively easy-to-clean extractor device with a leaf spring. The advantages of a leaf spring with regard to thermal resistance and high spring force can be used. According to the present disclosure, the extractor is first installed by pivoting the bearing protrusion about the extractor axis. Due to the rearwardly facing bearing opening, the extractor can move forward within the boundaries of the cavity and is still held radially, i.e. outwardly in the normal direction, by the bearing protrusion on the extractor axis. In contrast to the known prior art, in which the leaf spring has to be inserted from the outside into the recess and wedged by subsequently pressing in the extractor, the leaf spring is mounted by pivoting it laterally into the recess. In this way, accidental damage or compression of the leaf spring during installation can be avoided, as the lateral insertion opening of the recess allows it to be placed under the spring bearing portion of the extractor first and then to be pressed downwardly or inwardly by comparatively gentle manual pressure on the comparatively long, rearwardly facing part of the leaf spring. The leaf spring can then be pivoted laterally into the undercut in the rear portion of the body in a comparatively simple manner.

In addition, the disclosed structure has the advantage that the forces on the extractor during the closing movement can be diverted into the bolt via the extractor axis and are not transferred to the leaf spring, whereby damage to the leaf spring by forces in the longitudinal direction can be avoided. Furthermore, if the extractor is subjected to tensile load when the bolt rotates backward, force is transmitted from the contacting surface to the locating surface, relieving the extractor axis, causing relatively little surface pressure on the body and thus introducing force in a manner that is gentle on the material. These measures could significantly increase the service life of the bolt.

Further embodiments and modifications of the disclosed bolt apparatus, in particular the shape of the body, the leaf spring, and/or the extractor, are explained below in conjunction with the content of the associated of the drawings. The respective advantages over the known prior art are also described at a suitable point.

As used in the present disclosure, the terms left, right, up, down, front and rear always refer to a shooter's view in the firing direction of the firearm when said firearm is held ready to fire. In the description and the claims, the terms "front," "rear," "above," "below," "inside," "outside," and so on are used in the generally accepted form and with reference to the object in its usual use position. This means that, for the weapon, the muzzle of the barrel is at the "front," that the breechblock or carriage is moved "backward" by the explosive gas, etc. Transverse to a direction substantially means a direction rotated by 90°.

In the installation situation, the bolt 1, going through the barrel axis 9, has a barrel direction 91 in the following. In the transverse direction to this, a normal direction 93 pointing outwardly, in the selected illustration "up," is indicated and a rotation about the barrel axis 9 or the barrel direction 91 follows in the circumferential direction 92.

For the sake of clarity, not all reference signs are given in every (partial) figure for the same components and features. The connections should also be easy to understand for a person skilled in the art.

Figure 1B:
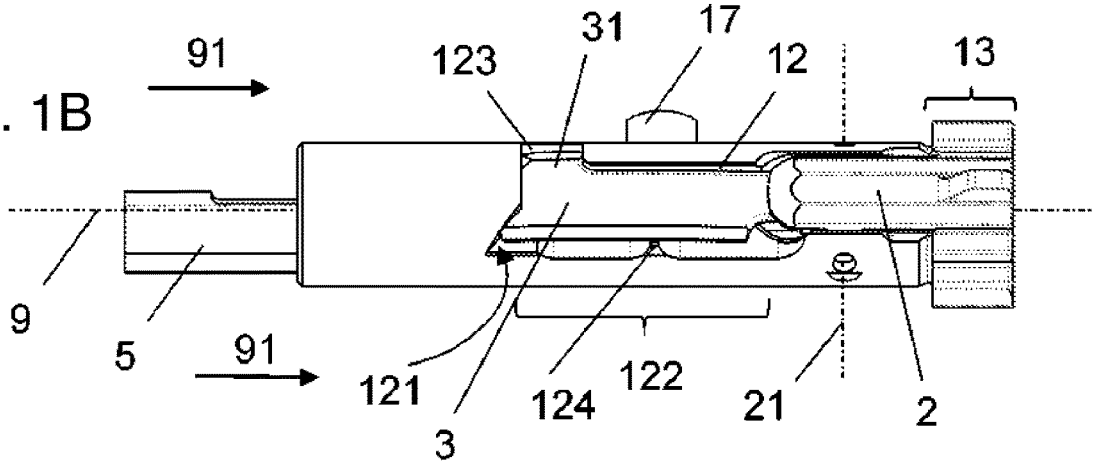

FIGS. 1A and 1B schematically show a bolt 1 in two side views, with the barrel direction 91 pointing to the left (FIG. 1A) and the barrel direction 91 pointing to the right (FIG. 1B). On the barrel side of the cylindrical body 11, the bolt 1 has a locking portion 13 with a plurality of locking lugs 14 protruding radially to the outside.

In FIG. 1A, a hollow on the body 11 can be seen, in which an ejector 5 is inserted movably in the longitudinal direction. The ejector 5 is designed to impinge parallel to the barrel axis 9 on an edge portion of the breech face 15 through the ejector opening 51 on the bottom of the case of a cartridge case 4. An outwardly protruding cam pin 17 is also formed on the body 11, which in this case is shown formed integrally with the body 11.

FIG. 1B shows the bolt 1 in the assembled state, viewed from the opposite side from FIG. 1A. Looking at the following figures together, it can be seen very clearly that the extractor 2 and a leaf spring 3 are arranged in a recess 12 running rearwardly from the breech face 15 of the locking portion 13. The recess 12 can substantially be viewed as groove-shaped. It preferably runs parallel to the barrel axis 9 as a flat surface, with planes inclined relative to the barrel axis 9 also being possible in order, for example, to adjust the pretension and/or the clearance of the leaf spring 3 in a targeted/predefined manner. It is substantial, however, that the recess 12 for receiving the leaf spring 3 is laterally open at least partially on one side tangentially to the circumferential direction 92, via an insertion portion 122. The recess 12 merges rearwardly into an undercut 121 in which the rear end section of the leaf spring 3 is received. The undercut 121 can be opened laterally—as shown—whereby the pivoting of the leaf spring 3 is additionally facilitated.

Figure 2:
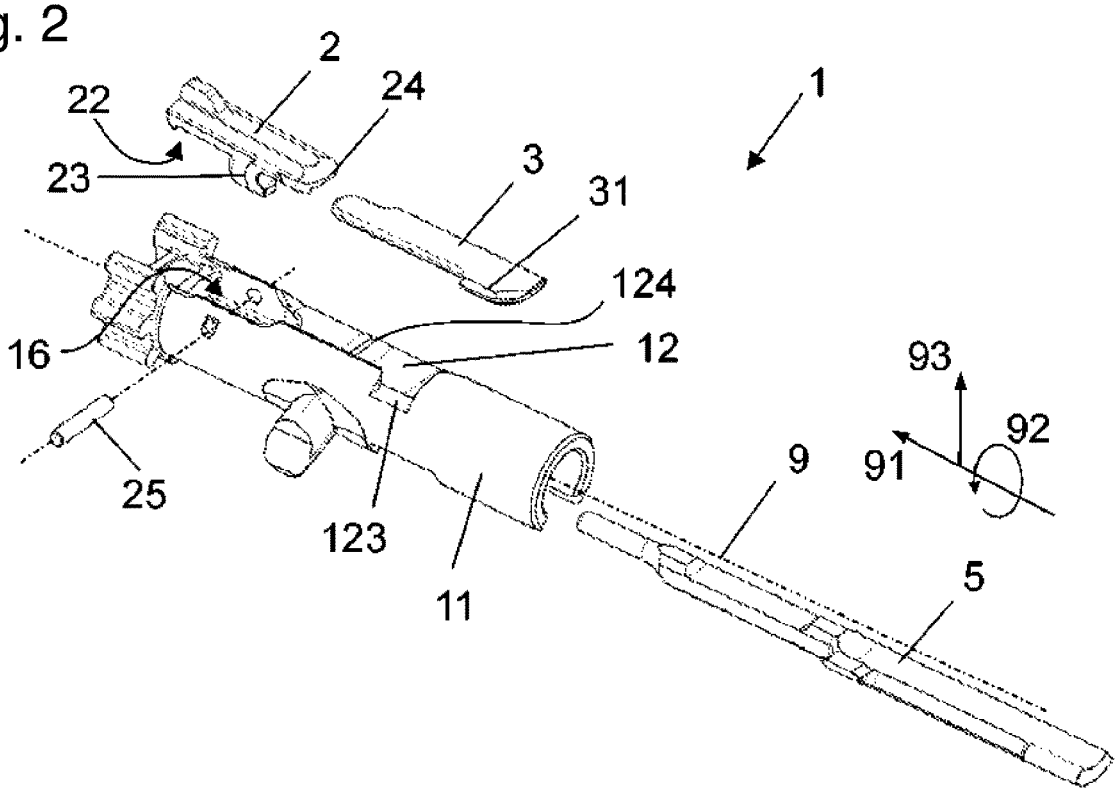
FIG. 2 is a simplified exploded view of a bolt according to the present disclosure.

FIG. 2 shows the bolt 1 in a kind of exploded view. In this illustration, looking at FIGS. 6A-6C and 7A-7C together, it can be seen clearly that the extractor 2, viewed in the installed state, has a first and a second lever arm, as well as a bearing protrusion 23 protruding inwardly from a central portion. The bearing protrusion 23 is used in the installed state to abut against and for delimited tilting about an extractor axis 21 (FIG. 1B, this means both the axis of rotation itself and its design as a shaft, pin, etc.) and is designed to be hook-shaped with the bearing opening 231 open rearwardly, i.e. counter to the barrel direction 91 (FIG. 7A).

Figure 7A:
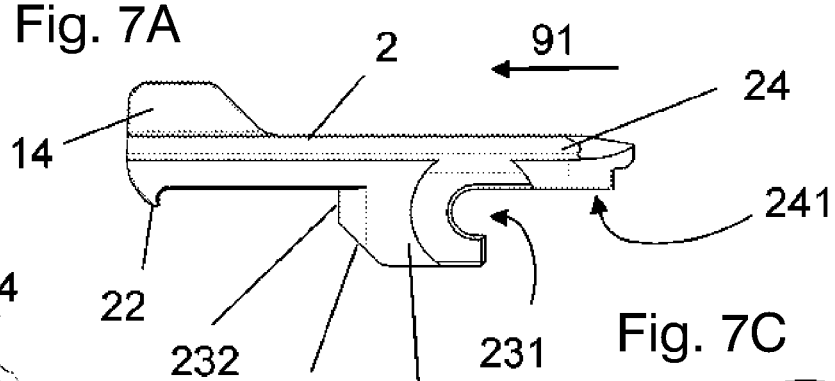
FIGS. 7A-7C show an embodiment of an extractor according to the present disclosure in different views.
Figure 7B:
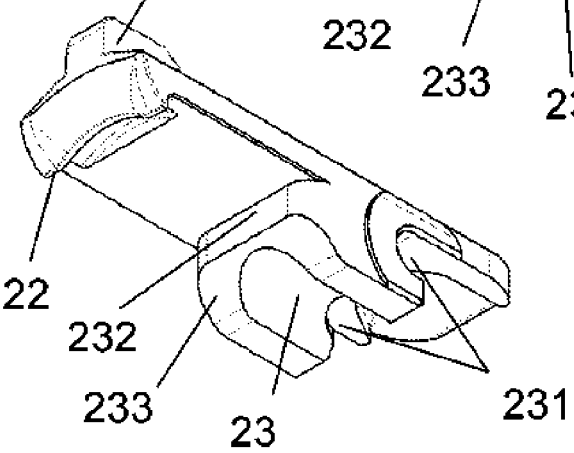
Figure 7C:
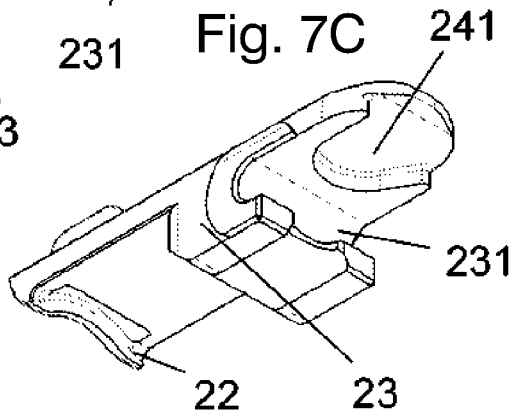

As illustrated particularly well in FIGS. 7A to 7C, an inwardly protruding, hook-shaped extractor claw 22 is arranged on the first lever arm, which is used to engage in the edge of a cartridge case 4. It can also be seen very clearly from these illustrations that the extractor 2 has a second, rearwardly protruding lever arm, which serves as a spring bearing portion 24, on which the leaf spring 3 engages on the underside in the installed state and pushes it to the outside. This serves to pretension the extractor claw 22 inwardly, in the direction of the barrel axis 9.

It has proven to be advantageous that, in a preferred embodiment, a spring bearing pocket 241 is provided on the underside of the spring bearing portion 24 (also FIG. 2). This is particularly preferably designed to be complementary in shape to the end section 32 of the leaf spring 3 (FIG. 2), which is aligned on the barrel side, and can, for example, be seen very clearly in FIG. 7C when looking at FIGS. 1A-1B and 8A-8B together. This spring bearing pocket 241 has the advantage that it can serve as a kind of insertion aid during the assembly of the leaf spring 3 and also serves as a lateral guide. Depending on the depth of the hollow, the spring bearing pocket 241 can even serve as an additional measure against unintentional slipping or shaking out of the front end section of the leaf spring 3. This can further improve the functionality of the firearm.

In FIG. 2, the leaf spring 3 is also shown, which is shown in more detail in a detailed illustration in FIG. 8 and is described in more detail below. The ejector 5 can also be seen in this illustration, whereby alternatively designed ejectors with the bolt 1 according to the present disclosure or the extractor 2 can easily be provided by a person skilled in the art. Furthermore, the extractor axis 21, which is designed as a separate axis pin 25, can be seen clearly in FIG. 2. It is also possible, however, to form this extractor axis 21 integrally on the body 11, as shown when looking at FIGS. 3A and 4A together.

As can be seen in the exploded view of FIG. 2, the body 11 has a cavity 16 for receiving the bearing protrusion 23 relative to an imaginary plane of the recess 12 in the region of the extractor axis 21. This cavity 16 can be designed as a continuous pocket or in the form of a plurality of pocket-shaped partial cavities in the direction of the barrel axis 9, as can be seen clearly when looking at FIGS. 3A-3B and 4A-4B together.

At this point, it should be mentioned that the cavity 16 is delimited toward the front in the barrel direction 91 by the breech face 15 or its rear wall, as a result of which a locating surface 183 for the extractor 2 is formed toward the front. The bearing protrusion 23 has on its front side a corresponding contacting surface 232, which serves to stop or support on the locating surface 183 in the holding position. The cavity 16 is formed in the region of the extractor axis 21 relative to an imaginary plane of the recess 12. Counter to the barrel direction 91, the cavity 16, starting from the extractor axis 21, has sufficient free space that the leaf spring 3 can be displaced when the cartridge case 4 is gripped, see also FIGS. 6A to 6C. In this way, the extractor axis 21 can interact with the bearing protrusion 23 as a hinge or pivot point for the two lever arms.

Figure 6A:
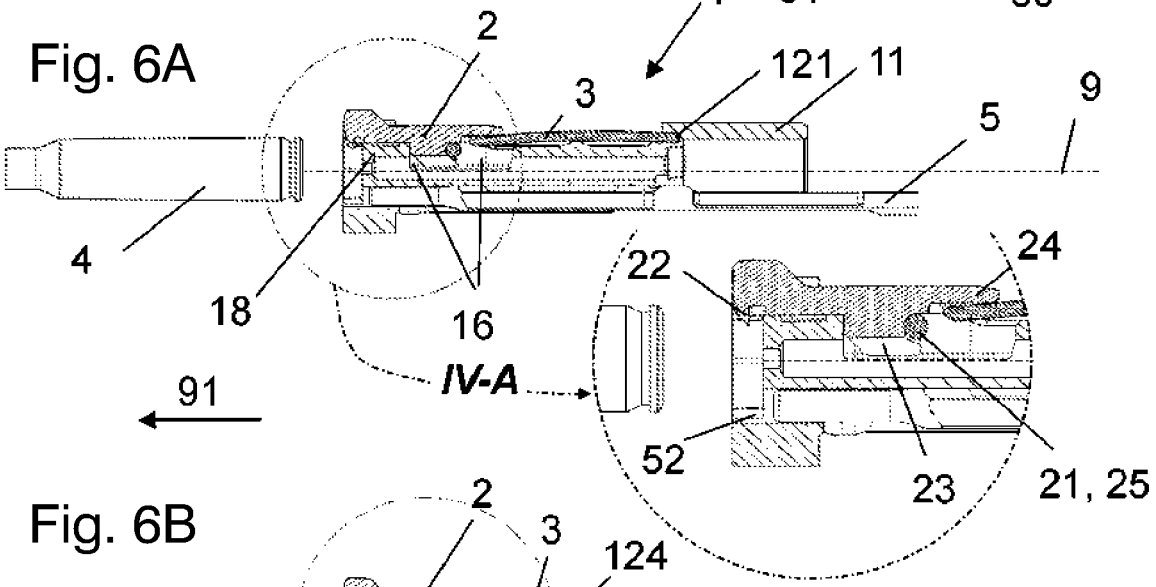
FIGS. 6A-6C show a sequence of movements with the bolt in the rest position (FIG. 6A), in the deflected position of the extractor (FIG. 6B), and in the holding position (FIG. 6C)

In a special embodiment, the cavity 16 is delimited by an additional support portion 18 extending rearwardly from the breech face 15 to the locating surface 183, which contributes to stiffening the bolt 1 and thereby reducing the resilient deformation during the closing or extraction process. The support portion 18 preferably has a longitudinal extension of 0.1 to 1.5 times, in particular 0.4 to 0.8 times, the mean diameter of the body 11. The support portion 18, which can also be seen very clearly in FIGS. 4A and 4B, extends so far back counter to the barrel direction 91 to the adjacent cavity 16 that a pivotable insertion of the extractor 2 is made possible by pivoting the bearing protrusion 23 about the extractor axis 21 with the leaf spring 3 element removed; however, with an extractor 2 in the rest position, as can be seen in FIG. 6A, a radial movement of the extractor 2 is prevented by the bearing protrusion 23 at least partially looping around the extractor axis 21. The support portion 18 is delimited at the rear by a locating surface 183, which comes into contact with the contacting surface 232 as flatly as possible during the extraction process.

Figure 6B:
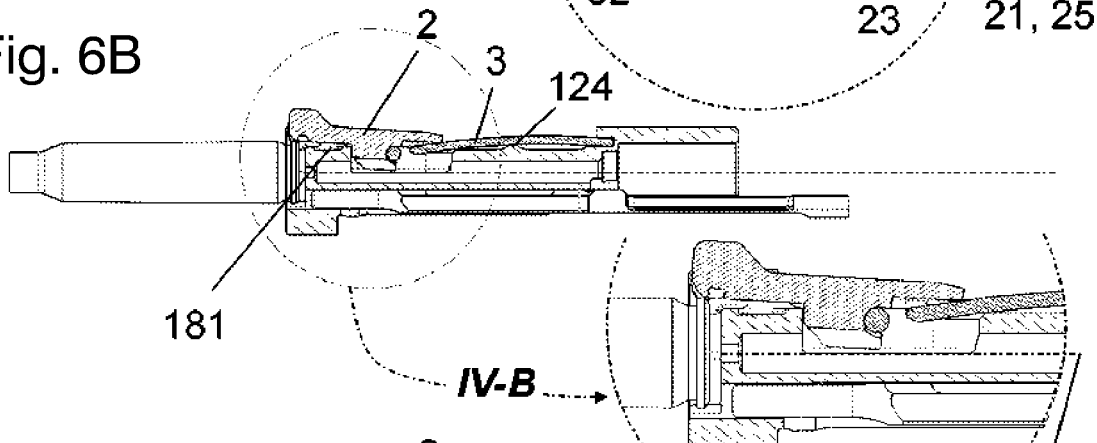
Figure 6C:
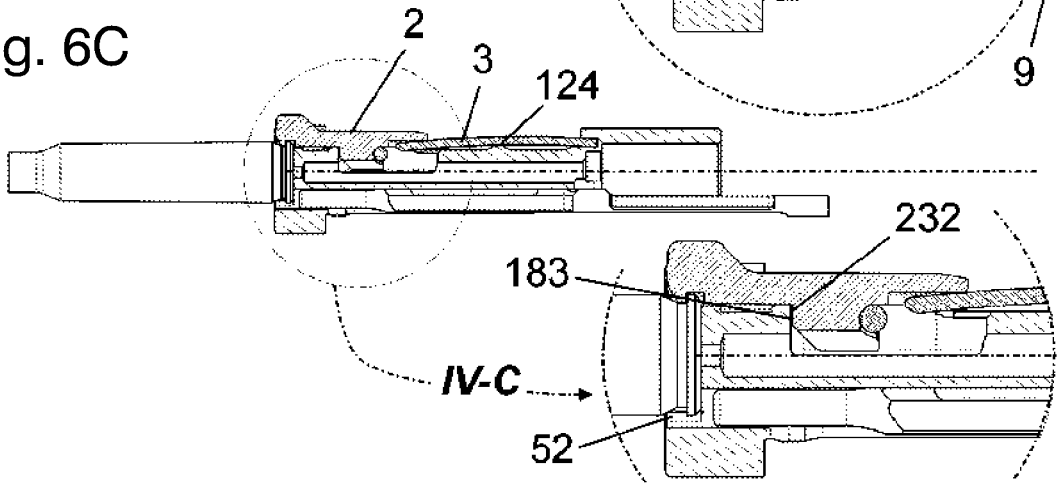

In addition, from the sequence of movements in FIGS. 6A to 6C, in particular when looking at FIGS. 2, 7A, 7B, 9A and 9B together, a particularly preferred embodiment can be seen, according to which the bearing protrusion 23 can have an insertion chamfer 233 between its underside in the direction of the extractor claw 22, preferably up to the contacting surface 232. Such a taper can facilitate the introduction or pivoting of the bearing protrusion 23 about the extractor axis 21. In addition, the longitudinal extension of the support portion 18 can be enlarged rearwardly, whereby the clearance between the bearing protrusion 23 and the support portion 18 can be optimized. During the extraction process, the tensile load is applied to the extractor claw 22 after a very short distance—as soon as the contacting surface 232 comes into contact with the locating surface 183. The brief jolt that occurs is also advantageous for the process of extracting the cartridge case 4 from the chamber.

Figure 3A:
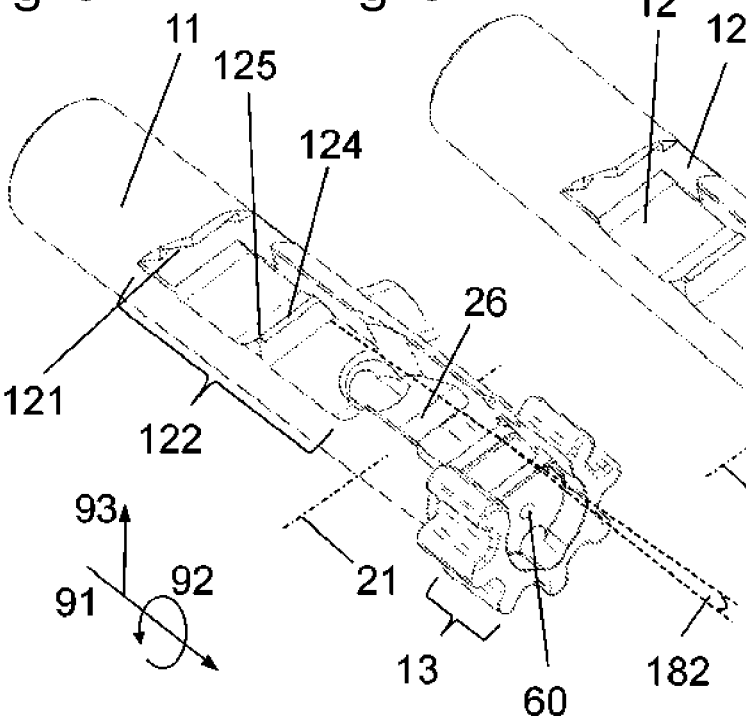
FIG. 3A shows a bolt with an integrally formed extractor axis.
Figure 3B:
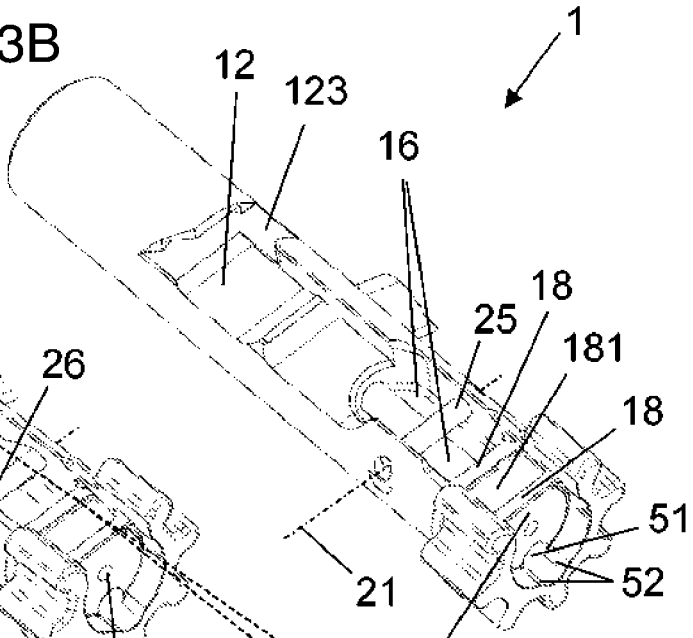
FIG. 3B shows a bolt with a bearing pin.

With reference to FIGS. 3A and 3B, it can be advantageous in special cases that the support portion 18 has a trough-shaped pocket 181. This pocket 181 could be referred to as a "dirt pocket," since smaller dirt particles, undesired oil accumulations and the like can escape thereinto. As a result, the risk of insufficient pivoting movement of the extractor 2 due to dirt accumulation between extractor 2 and body 11, for example, can be reduced, which improves functionality.

Figure 4A:
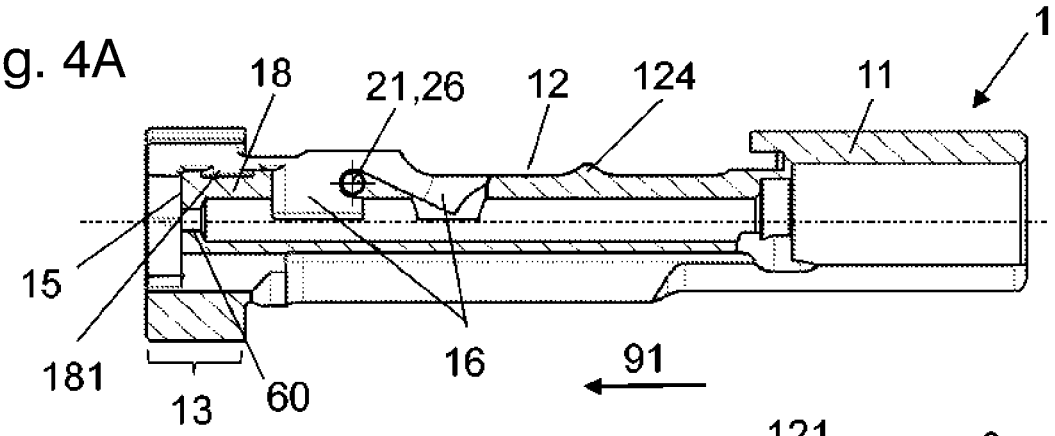
FIGS. 4A and 4B are sectional views of the bolts corresponding to those depicted in FIGS. 3A and 3B, respectively, along the sectional plane B-B' shown in FIG. 5B.
Figure 4B:
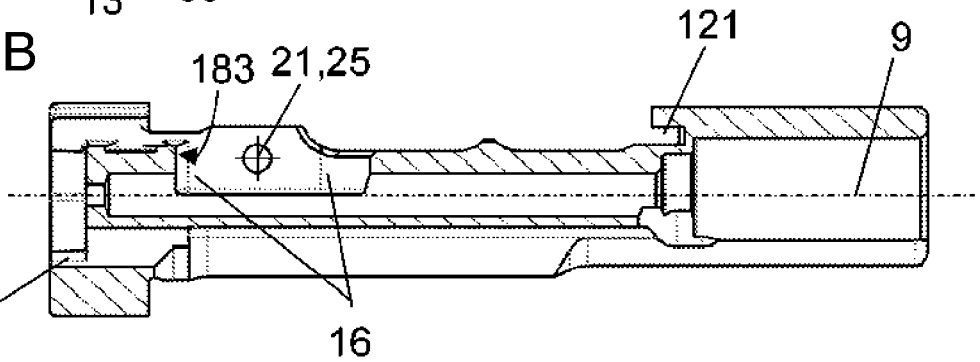

FIGS. 3A and 3B show oblique views of different embodiments of bolts 1, the essential difference being the design of the extractor axis 21, see FIGS. 4A and 4B in comparison. FIG. 3A shows a bolt 1, the extractor axis 21 of which, coming from the manufacturing process, is designed integrally with the body 11 as a type of land 26. In the integral embodiment, this land 26 thus forms the extractor axis 21 and is preferably rounded in the contact portion in order to abut against the bearing protrusion 23 or the bearing opening 231 thereof. As can be seen clearly from FIG. 4A, the land 26 is designed sloping rearwardly in the direction of the cavity 16, whereby the pivotable insertion of the extractor 2 is made possible. Such an integral design of the extractor axis 21 increases the rigidity of the bolt 1 under load and also reduces the number of components and the assembly effort. In addition, the risk of a breakage of the axis pin 25, which is shown comparatively in the oblique view in FIG. 3B, can be reduced.

In FIGS. 3A and 3B, the groove-shaped recess 12 with the laterally opened insertion portion 122 can be seen very clearly. The recess 12 can be aligned as a type of flattening tangentially to the circumferential direction 92 and merges into the undercut 121 in the rear region. The undercut 121 has a height which corresponds approximately to the thickness of the leaf spring 3. In a particular embodiment, this undercut 121 can be pocket-shaped and closed laterally on at least one side, as can be seen very clearly from FIGS. 3A and 3B. This prevents the leaf spring 3 from being accidentally "overly pivoted" during installation, thereby promoting functional reliability.

Another possible embodiment is aimed at being able to adjust the pretension of the leaf spring 3 in a targeted manner. As shown by way of example in all figures with the aid of a line-shaped protrusion 124, the possibility of the targeted formation of a support for the leaf spring 3 by means of one or more point-shaped or also line-shaped protrusions 124 should be mentioned. This protrusion 124 can be seen clearly in the sectional view in FIGS. 4A and 4B, which is directed to the sectional plane B-B' of FIG. 5B. A person skilled in the art is responsible for setting the pretension on the leaf spring 3 in a targeted manner by selecting the height, position, and shape of the protrusion 124.

In another, supplementary or also independently designed embodiment, at least one step 125 can be integrally formed on the recess 12 and/or on a provided protrusion 124, laterally to the outside. This step 125 can be perceived as a clearly noticeable detent when the leaf spring 3 is pivoted in, which allows the user to determine the correct position of the leaf spring 3 when it "latches" or "snaps" into the correct position. In addition, such a step 125 can serve as a resistance against unintentional leaving of the correct position of the leaf spring 3 in the installation situation, whereby an additional measure can be implemented to increase the functionality in the highly dynamic movement processes in the operating state.

In addition, FIG. 3A shows an example of a further possibility of limiting or specifically adjusting the movement of the extractor 2, in that the support portion 18 is formed at an angle relative to the barrel axis 9. As indicated qualitatively in FIG. 3A, the support portion 18 can be inclined in the barrel direction 91 by an inclination angle 182 toward the barrel axis 9. The inclination angle 182 is preferably from 1° to 5° relative to the barrel axis 9. In this way, a slight tilting of the extractor 2 toward the barrel axis 9 can be made possible, whereby, among other things, the gripping of the cartridge case 4 can be improved.

Figure 5A:
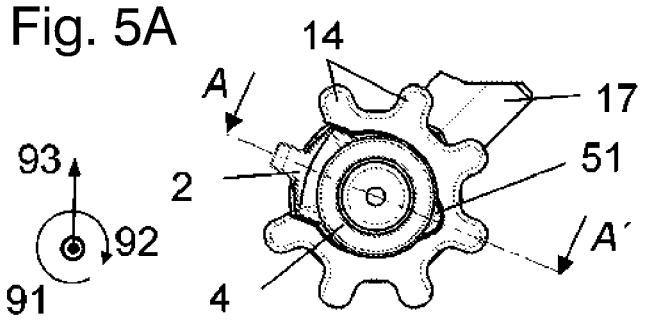
FIG. 5A shows a front view of a bolt with extractor and cartridge case in front.
Figure 5B:
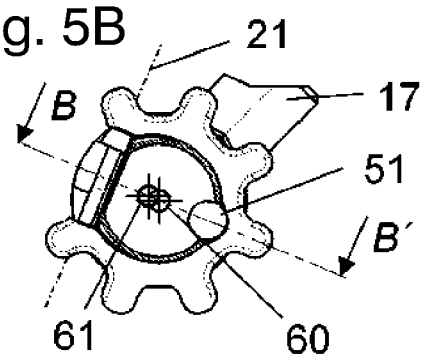
FIG. 5B shows a front view of a bolt without extractor and cartridge case.

FIGS. 4A and 4B are cross-sectional views of the bolts 1 from FIGS. 3A and 3B, which correspond to the sectional plane of the illustration in FIG. 5B. In the cross section, the central firing pin channel can be seen very well, which allows a firing pin to pass through by means of a firing pin opening 60 on the breech face 15.

FIGS. 5A and 5B each show a bolt 1 with and without an extractor 2, respectively. In FIG. 5A, an empty cartridge case 4, which is gripped by the extractor 2 at the case edge thereof, is also shown in the front view.

The illustration in FIGS. 6A-6C shows schematically a sequence of movements on the section plane A-A' as indicated in FIG. 5A. In FIG. 6A, the extractor 2 is in the rest position, the leaf spring 3 clearly engaging the spring bearing portion 24 on the underside and pressing the extractor claw 22 inwardly. In the enlarged illustration IV-A, it can be seen clearly that the support portion 18 extends so far rearwardly that the bearing protrusion 23 can still be pivoted inwardly. Looking at FIGS. 7A-7C and 9A-9B in combination, it can be seen that the bearing protrusion 23 can also be designed with two feet, which is why part of the bearing protrusion 23 can be seen in section and part of the foot can be seen in the side view in the cross-sectional views of FIGS. 6A-6C. However, the at least partial looping around the extractor axis 21, which in this case is shown as an axis pin 25, can be seen clearly.

FIG. 6B illustrates the state which shows the extractor 2 in a deflected position, which takes place when gripping the cartridge case 4 in the course of the closing process. See also detail IV-B, in which the deflection of the leaf spring 3 can be seen clearly.

In FIG. 6C the gripped cartridge case 4 can be seen in the extractor 2, which can be referred to as the holding position. From the detail IV-C, it can be seen that the first lever arm is slightly spaced from the support portion 18 in this position, as a result of which a high holding force acts on the cartridge case 4. In addition, the contact between the contacting surface 232 of the bearing protrusion 23 and the locating surface 183 of the body 11 or the support portion 18 can be recognized. In this illustration, the two surfaces are designed substantially normal to the barrel axis 9. The necessary free spaces between the bearing protrusion 23 and the locating surface 183 are to be provided by a person skilled in the art in such a way that the pivotable installation is made possible.

Another particularly preferred embodiment can be seen when looking at FIGS. 5B, 6A-6C, and 3A-3B in combination, according to which the breech face 15 (FIG. 3B is substantially designed as a slot hole. As can be seen clearly in FIG. 5B, the breech face 15 can have a first and a second center point for the slot hole. The first center point is formed by the firing pin opening 60 and the second center point 61 is arranged offset in the direction of the extractor 2, starting from an ejector opening 51 arranged in the edge portion of the breech face 15. This measure allows slight positional deviations of the cartridge case 4 relative to the bolt 1 to be compensated for even with a high rate of fire and the cartridge case 4 to be gripped with high precision and pressed against the opposite rounding of the locking portion 13 by the force of the extractor claw 22 along the slot hole. In this way, the cartridge case 4 abuts against the breech face 15 in a position which assists the correct functioning of the ejector 5.

A modification of the bolt 1 can also provide that a centering taper 52 starting from the ejector opening 51 is formed in the circumferential direction on the inner wall of the locking portion 13. These centering tapers 52 can be seen clearly in FIGS. 3A and 3B and can also be seen in FIGS. 6A-6C. The centering tapers 52 ensure that the gripped cartridge case 4 abuts against the inner wall of the locking portion 13, precisely in front of the ejector opening 51, by the force of the extractor 2 along the centering tapers 52 in a predefined position on the breech face 15. This measure makes it possible for the cartridge case 4 to be consistently hit at the same angle by the ejector 5 relative to the extractor 2. In this way, the precision when ejecting the cartridge case 4 can be improved to the effect that the cartridge cases 4 are reproducibly ejected at the same angle from the ejection opening of the firearm.

Figure 8A:
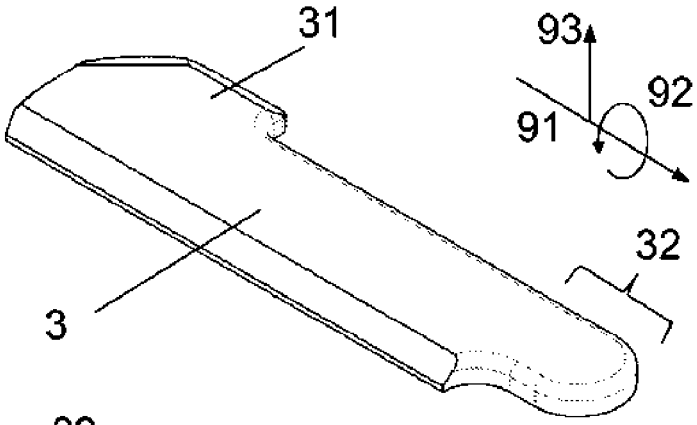
FIGS. 8A and 8B show an embodiment of a leaf spring in different views.
Figure 8B:
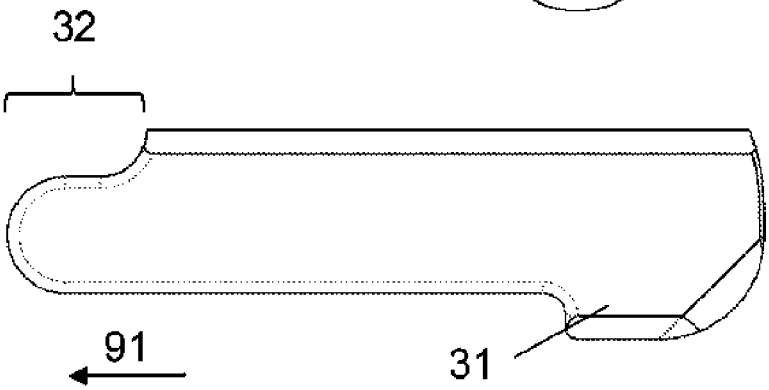

FIG. 8A shows an example of a leaf spring 3 in an oblique view or top view (FIG. 8B, which is particularly well suited for the bolt 1 and extractor 2 according to the present disclosure. The leaf spring 3 has a longitudinal extension in the barrel direction 91 and a substantially smaller strength in the normal direction 93. The lateral extension and shape can vary over the length of the leaf spring 3, as shown. Likewise, tapers on the edges and/or edge portions can serve to facilitate assembly.

As can be seen clearly in FIGS. 8A and 8B, in one possible embodiment, the leaf spring 3 can have a reduced cross section at its barrel side end section 32 relative to its mean width, viewed in the installation situation, and this cross section can be substantially circularly rounded at its barrel side end. Such a shaped and narrower than the mean width of the leaf spring 3 at its front end section 32 has the advantage that the leaf spring 3 is easier to insert into the insertion portion 122. A narrowed end section 32 is particularly advantageous in order to interact with a previously mentioned, optionally to be provided, spring bearing pocket 241, as can be seen clearly in FIGS. 7A-7C, resulting in the same advantages as mentioned above.

As can be seen when looking at FIGS. 1A, 1B, 2, 3A and 3B in combination, in a preferred embodiment the body 11 can have a recess 12 on which a disassembly opening 123 is provided laterally, on the side opposite the insertion portion 122. This disassembly opening 123 has a size that a fixed leaf spring 3 can be pushed out of the recess 12 laterally with the finger or a simple auxiliary tool (possibly with the tip of a cartridge), whereby the dismantling of the leaf spring 3 is made much easier if necessary.

In a particularly preferred embodiment, the leaf spring 3 has a lateral extension which is designed analogously to the disassembly opening 123, preferably with a shape complementary to it. This blocking member 31 can be seen very clearly in FIG. 2 and FIGS. 8A and 8B and has a longitudinal extension which is designed to be complementary in shape for the contact in the region of the disassembly opening 123. By this measure, an unintentional longitudinal displacement of the leaf spring 3 in the operating state forward in the barrel direction 91 can be limited or even prevented. As a result, a pressure load on the leaf spring 3 in the direction of the longitudinal extension thereof can be reduced and the service life of the leaf spring 3 can be prolonged.

Figure 9A:
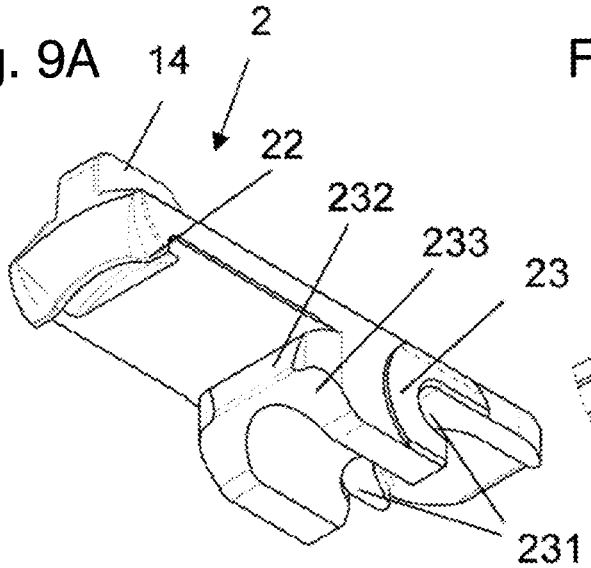
FIG. 9A shows a further embodiment of an extractor.
Figure 9B:
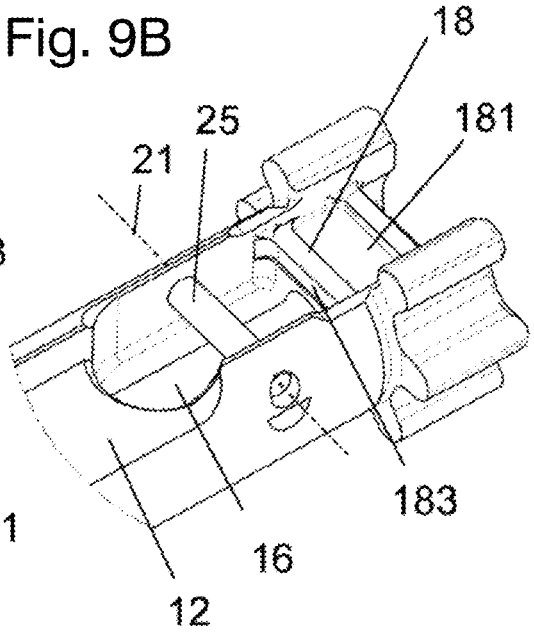
FIG. 9B shows a further embodiment of a bolt.

In FIGS. 9A-9B and 10A-10B, a bolt 1 can be seen schematically in a further, preferred embodiment without a leaf spring 3. In FIG. 9A, an extractor 2 can be seen, the contacting surface 232 of which is formed at an oblique angle to the barrel direction 91. The locating surface 183 in FIG. 9B is designed to be complementary to this inclined contacting surface 232. The contacting surface 232 and the locating surface 183 are thus each tapered relative to the normal direction 93 in such a way that when the extractor 2 is subjected to tensile load to the front, the extractor 2 is displaced inwardly in the direction of the barrel axis 9. This relationship can be seen very well from the holding position in FIGS. 10A and 10B, which corresponds to a sectional view on the sectional plane A-A' analogous to FIG. 5A, applied to the extractor 2 and the body 11 from FIGS. 9A and 9B.

Figure 10A:
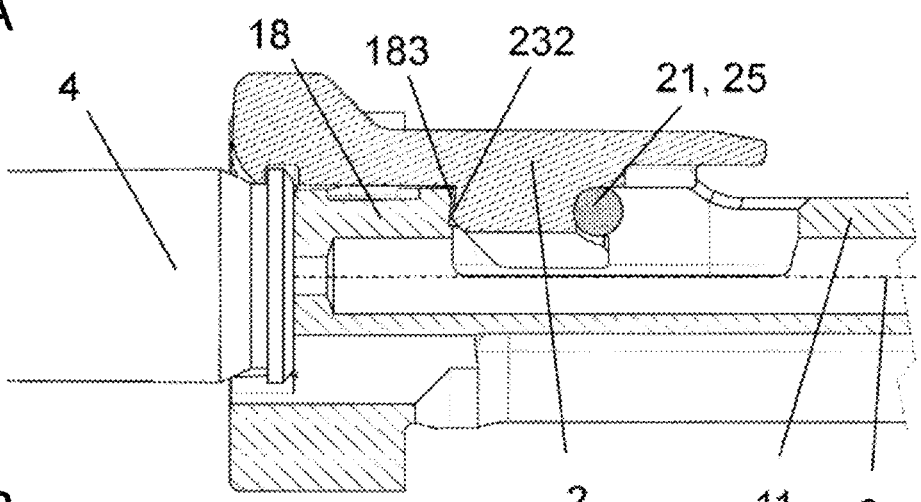
FIGS. 10A and 10B show a simplified sequence of movements with the bolt and extractor in the holding position (FIG. 10A) and the self-locking holding position (FIG. 10B).
Figure 10B:
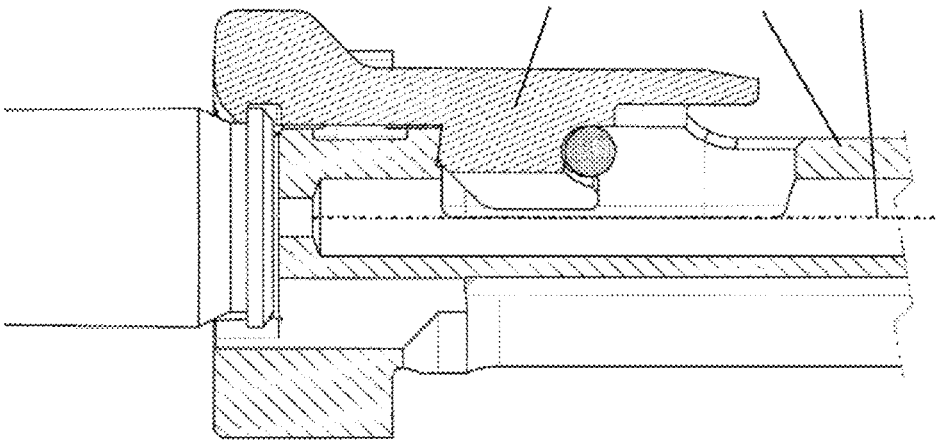

In FIG. 10A, the holding position of the bolt 1 can be seen in the detailed illustration—analogous to FIG. 6C. As explained above, the taper of the contacting surface 232 and the locating surface 183 allows the extractor 2 to be displaced into a self-locking holding position of the cartridge case 4 under tensile load on the extractor 2, as illustrated in FIG. 10B with the aid of the dashed movement arrow (without reference signs)—substantially parallel to the taper mentioned. As a result, the risk of undesired release of the cartridge case 4, for example due to vibrations, can be further reduced, in particular at very high firing rates, whereby the reliability of the bolt 1 can be further increased.

This variant can easily be combined with the aforementioned embodiments, whereby the advantages mentioned can also be achieved here mutatis mutandis. Likewise, designs with complementary shapes of the contacting surface 232 and the locating surface 183, e.g. angular or rounded, which allow the same function, namely an improved holding position of the cartridge case 4 when pulling the extractor 2 forward, are also conceivable. The proposed measures reduce, in a way that is easily comprehensible to a person skilled in the art with knowledge of the present disclosure, the risk that an unintentional movement of the extractor 2 counter to the barrel direction 91 and/or in the normal direction 93 immediately causes the extractor 2 to loosen from the cartridge case 4.

The bolts of the present invention are not limited to the illustrated and described embodiments but can be modified and configured in various ways. In particular, the shown cross-sectional shapes of the mentioned receiver parts, pins, rails, recesses, etc. can be adapted to the given basic data, and the lengths and the positions with respect to the receiver can also be easily adapted by a person skilled in the art with knowledge of the invention. In particular, equivalent designs are obvious with knowledge of the disclosure and can be carried out without further ado by a person skilled in the art.

It should also be noted that in the description and the claims, terms such as the "lower region" of an object refer to the lower half and in particular the lower quarter of the overall height; "lowermost region" refers to the lowermost quarter and in particular an even smaller part, while "central region" refers to the central third of the overall height. For the terms "width" or "length," this applies mutatis mutandis. All of these terms have their generally accepted meaning applied to the intended position of the object under consideration.

In the description and the claims, "substantially" means a deviation of up to 10% of the stated value, if physically possible, both downward and upward, otherwise only in the appropriate direction; in the case of degrees (angle and temperature), and for indications such as "parallel" or "normal," this means±10°. If there are terms such as "substantially constant" etc., what is meant is the technical possibility of deviation which the person skilled in the art takes as a basis and not the mathematical one. For example, a "substantially L-shaped cross section" comprises two elongated surfaces, which merge at one end into the end of the other surface, and whose longitudinal extension is arranged at an angle of 45° to 120° to each other.

All given quantities and percentages, in particular those relating to the limitation of the invention, insofar as they do not relate to specific examples, are understood to have a tolerance of ±10%; accordingly; for example, 11% means from 9.9% to 12.1%. With designations such as "a solvent," the word "a" is not to be considered to be a numeral, but rather a pronoun, unless the context indicates otherwise.

The term: "combination" or "combinations," unless otherwise stated, mean all types of combinations, starting from two of the relevant components up to a plurality or all of such components; the term "containing" also means "consisting of."

The features and variants stated in the individual embodiments and examples can easily be combined with those of the other examples and embodiments and in particular can be used for characterizing the invention in the claims without necessarily including the other details of the particular embodiment or of the particular example.

LIST OF REFERENCE SIGNS

| | |
|---|---|
| 1 | Bolt |
| 11 | Body |
| 12 | Recess |
| 121 | Undercut |
| 122 | Insertion portion |
| 123 | Disassembly opening |
| 124 | Protrusion |
| 125 | Step |
| 13 | Locking portion |
| 14 | Locking lugs |
| 15 | Breech face |
| 16 | Cavity |
| 17 | Cam pin |
| 18 | Support portion |
| 181 | Pocket |
| 182 | Inclination angle |
| 183 | Locating surface |
| 2 | Extractor |
| 21 | Extractor axis |
| 22 | Extractor claw |
| 23 | Bearing protrusion |
| 231 | Bearing opening |
| 232 | Contacting surface |
| 233 | Insertion chamfer |
| 24 | Spring bearing portion |
| 241 | Spring bearing pocket |
| 25 | Axis pin |
| 26 | Land |
| 3 | Leaf spring |
| 31 | Blocking member |

-continued

| | |
|---|---|
| 32 | End section |
| 4 | Cartridge case |
| 5 | Ejector |
| 51 | Ejector opening |
| 52 | Centering taper |
| 60 | Firing pin opening |
| 61 | Second center point |
| 9 | Barrel axis |
| 91 | Barrel direction (front) |
| 92 | Circumferential direction |
| 93 | Normal direction (outwards) |

The invention claimed is:

1. A bolt for a firearm, including an extractor for cartridge cases, comprising:

a cylindrical body, wherein on a side of the cylindrical body nearest a barrel of the firearm is formed a locking portion having a breech face, at least two radially outwardly projecting locking lugs, and a groove-shaped recess extending rearwardly from the breech face;

wherein the groove-shaped recess defines an undercut that is configured to receive the extractor and a leaf spring; the groove-shaped recess is laterally open at least partially on one side tangentially to a circumferential direction, via an insertion portion, and merges laterally and/or rearwardly into the undercut;

the extractor, which when installed with the cylindrical body has a first lever arm on a barrel side of the cylindrical body, the first lever arm including an inwardly protruding, hook-shaped extractor claw; and, in a central portion of the extractor, has an inwardly-projecting bearing protrusion and a second lever arm including a rearwardly-projecting spring bearing portion that is configured to be mounted on the cylindrical body so as to be pivotable about an extractor axis, and to interact with the leaf spring to pretension the extractor;

wherein the bearing protrusion is designed to be hook-shaped so as to abut against the extractor axis when installed, and defines a rearwardly-opening bearing opening, and includes a contacting surface on a barrel side of the bearing protrusion; and the cylindrical body further defines a cavity for receiving the bearing protrusion relative to an imaginary plane of the recess in a region of the extractor axis.

2. The bolt for a firearm according to claim 1, wherein the cavity is delimited on a barrel side toward a front by a support portion extending from the breech face rearwardly to a locating surface in such a way that an insertion of the extractor is made possible by pivoting the bearing protrusion about the extractor axis when the leaf spring is removed.

3. The bolt for a firearm according to claim 1, wherein the bearing protrusion includes an insertion chamfer from an underside of the bearing protrusion and extending toward the extractor claw.

4. The bolt for a firearm according to claim 1, wherein an end section of the leaf spring towards the barrel, as the leaf spring is installed in the cylindrical body, has a reduced cross-section relative to a mean width of the leaf spring, and the reduced cross-section is substantially circularly-rounded at its barrel-side end.

5. The bolt for a firearm according to claim 1, wherein the undercut defined by the groove-shaped recess is for at least partially receiving a rear portion of the leaf spring and is pocket-shaped and laterally closed.

6. The bolt for a firearm according to claim 2, wherein the support portion includes a trough-shaped pocket.

7. The bolt for a firearm according to claim 2, wherein the support portion is inclined toward a barrel axis on a side of the support portion nearest the barrel of the firearm.

8. The bolt for a firearm according to claim 7, wherein the support portion is inclined toward the barrel axis on a side of the support portion nearest the barrel of the firearm at an inclination angle of 1° to 5°.

9. The bolt for a firearm according to claim 1, wherein on a side of the cylindrical body opposite the insertion portion, the cavity laterally defines a disassembly opening.

10. The bolt for a firearm according to claim 9, wherein the leaf spring includes a lateral blocking member having a longitudinal extension that is complementary in shape for a contact in a region of the disassembly opening.

11. The bolt for a firearm according to claim 1, wherein at least one step is formed laterally to the outside in the recess, or the at least one step is formed on a point-shaped protrusion formed on the recess, or the at least one step is formed on a line-shaped protrusion formed on the recess, or the at least one step is formed in an edge portion on the recess.

12. The bolt for a firearm according to claim 1, wherein a spring bearing pocket is provided on an underside of the spring bearing portion.

13. The bolt for a firearm according to claim 1, wherein the breech face defines a slot hole having a first center point that is a firing pin opening and a second center point that is disposed offset from the first center point in a direction of the extractor, the slot hole extending away from an ejector opening defined in an edge portion of the breech face.

14. The bolt for a firearm according to claim 13, wherein a centering taper is formed on an inner wall of the locking portion, starting from the ejector opening and formed in a circumferential direction.

15. The bolt for a firearm according to claim 1, wherein the extractor axis is defined by an axis pin, or the extractor axis is formed integrally on the cylindrical body as a land.

16. The bolt for a firearm according to claim 2, wherein the contacting surface and the locating surface are tapered complementary to one another, such that when the extractor is subjected to tensile load in a forward direction, a displacement of the extractor is effected inwardly in a direction toward the barrel axis.

17. The bolt for a firearm according to claim 16, wherein the contacting surface and the locating surface are tapered complementary to one another relative to a direction normal to the barrel axis.

* * * * *